US008196565B2

(12) United States Patent
Giorgetti et al.

(10) Patent No.: US 8,196,565 B2
(45) Date of Patent: Jun. 12, 2012

(54) FLUID INJECTOR ASSEMBLY

(75) Inventors: Edoardo Giorgetti, Rosignano Marittimo (IT); Daniel Marc, Livorno (FR)

(73) Assignee: Continental Automotive GmbH, Hannover (DE)

( * ) Notice: Subject to any disclaimer, the term of this patent is extended or adjusted under 35 U.S.C. 154(b) by 411 days.

(21) Appl. No.: 12/497,167

(22) Filed: Jul. 2, 2009

(65) Prior Publication Data

US 2010/0031928 A1 Feb. 11, 2010

(30) Foreign Application Priority Data

Jul. 3, 2008 (EP) ..... 08012065

(51) Int. Cl.
*F02M 61/14* (2006.01)
*F02M 61/06* (2006.01)

(52) U.S. Cl. ..... 123/470; 123/467; 123/468; 123/469; 123/471; 123/491; 123/198 D; 123/198 E

(58) Field of Classification Search ..... 123/470, 123/467, 468, 469, 471, 491, 198 D, 198 E, 123/557; 239/133
See application file for complete search history.

(56) References Cited

U.S. PATENT DOCUMENTS

| | | | | |
|---|---|---|---|---|
| 5,361,990 | A * | 11/1994 | Pimentel | 239/133 |
| 5,724,946 | A * | 3/1998 | Franchitto | 123/470 |
| 6,561,168 | B2 * | 5/2003 | Hokao et al. | 123/557 |
| 2003/0150427 | A1 | 8/2003 | Liskow | |
| 2005/0263136 | A1 * | 12/2005 | Rigney | 123/470 |
| 2009/0199822 | A1 * | 8/2009 | Doherty | 123/456 |

FOREIGN PATENT DOCUMENTS

| | | | |
|---|---|---|---|
| WO | WO 02068813 | A1 | 9/2002 |
| WO | WO2005024224 | A1 * | 3/2005 |
| WO | WO 2005024224 | A1 | 3/2005 |

OTHER PUBLICATIONS

Extended European Search Report, European application No. 08012065.2-2311, 4 pages, Jan. 1, 2009.

* cited by examiner

*Primary Examiner* — Stephen K Cronin
*Assistant Examiner* — Raza Najmuddin
(74) *Attorney, Agent, or Firm* — King & Spalding L.L.P.

(57) ABSTRACT

A fluid injector assembly has a fluid injector (14) with a fluid inlet portion (16), a fluid injector cup (18) with an inner surface (30), an outer surface (28) and a heating device (32). The fluid inlet portion (16) of the fluid injector (14) has a sealing ring (26) being arranged and designed to sealingly engage the inner surface (30) of the fluid injector cup (18). The fluid injector cup (18) is designed to couple the heating device (32) thermally to the sealing ring (26) of the inlet portion (16) and to couple the fluid inlet portion (16) mechanically.

19 Claims, 3 Drawing Sheets

FLUID INJECTOR ASSEMBLY

CROSS-REFERENCE TO RELATED APPLICATIONS

This application claims priority to EP Patent Application No. 08012065 filed Jul. 3, 2008, the contents of which is incorporated herein by reference in its entirety.

TECHNICAL FIELD

The invention relates to a fluid injector assembly comprising a fluid injector and a fluid injector cup.

BACKGROUND

Fluid injector assemblies are in widespread use, in particular as fuel injector assemblies for combustion engines. Fuel can be supplied to a combustion engine by the fuel injector assembly that includes a fuel injector and a fuel injector cup. Fuel injectors can be coupled to fuel injector cups in different manners. In order to keep pressure fluctuations during the operation of the combustion engine at a very low level, combustion engines are supplied with a fuel accumulator to which the fuel injectors are connected and which has a relatively large volume. Such a fuel accumulator is often referred to as a fuel rail. Known fuel rails comprise a hollow body with recesses in the form of fuel injector cups, where the fuel injectors are arranged.

In order to enhance the combustion process in view of the creation of unwanted emissions, a respective fuel injector may be suited to dose fuel under very high pressures. In case of a gasoline engine the pressure may be, for example, in the range of up to 200 bar. The sealing of the coupling between the fuel injectors and the fuel injector cups has to withstand such high pressures. Such a sealing can be made of rubber.

In a low temperature environment a sealing made of rubber can become brittle if the surrounding temperature falls below the glass transition temperature of rubber. In order to prevent fluid leakage the operating pressure of fuel injector assemblies is reduced in low temperature environments. The reduction of the operating pressure can have an unwanted influence on emissions of the combustion engine.

SUMMARY

According to various embodiments, a fluid injector assembly can be created which is simply to be manufactured and which facilitates a reliable and precise connection between the fluid injector and the fluid injector cup, especially after a start of a combustion engine.

According to an embodiment, a fluid injector assembly may comprise a fluid injector with a fluid inlet portion, a fluid injector cup with an inner surface, an outer surface and a heating device, wherein the fluid inlet portion of the fluid injector comprising a sealing ring being arranged and designed to sealingly engage the inner surface of the fluid injector cup, the fluid injector cup being designed to couple the heating device thermally to the sealing ring of the inlet portion and to couple the fluid inlet portion mechanically.

According to a further embodiment, the heating device may be an electrical heater. According to a further embodiment, the heating device can be arranged on the outer surface of the fluid injector cup.

BRIEF DESCRIPTION OF THE DRAWINGS

Exemplary embodiments are explained in the following with the aid of schematic drawings. These are as follows.

Elements of the same design and function that occur in different illustrations are identified by the same reference characters.

DETAILED DESCRIPTION

According to various embodiments, a fluid injector assembly may comprise a fluid injector with a fluid inlet portion and a fluid injector cup with an inner surface, an outer surface and a heating device. The fluid inlet portion of the fluid injector comprises a sealing ring being arranged and designed to sealingly engage the inner surface of the fluid injector cup, the fluid injector cup being designed to couple the heating device thermally to the sealing ring of the inlet portion and to couple the fluid inlet portion mechanically. This allows to reliably seal the coupling of the fluid injector with the fluid injector cup of a fluid rail. More specifically, a reliable sealing can be ensured close to the start of the combustion engine in a low temperature environment in which the external temperature falls below the glass temperature of the sealing material. This enables to operate the fluid injector assembly under high pressures also at low temperatures.

In an embodiment the heating device is an electrical heater. This allows a simple construction of the heating device. A further advantage is that the energy can simply be provided by an electrical power source.

In a further embodiment the heating device is arranged on the outer surface of the fluid injector cup. This allows an easy assembly of the fluid injector cup and the fluid injector with regard to the thermo-coupling of the injector cup to the sealing ring.

Figure 1:
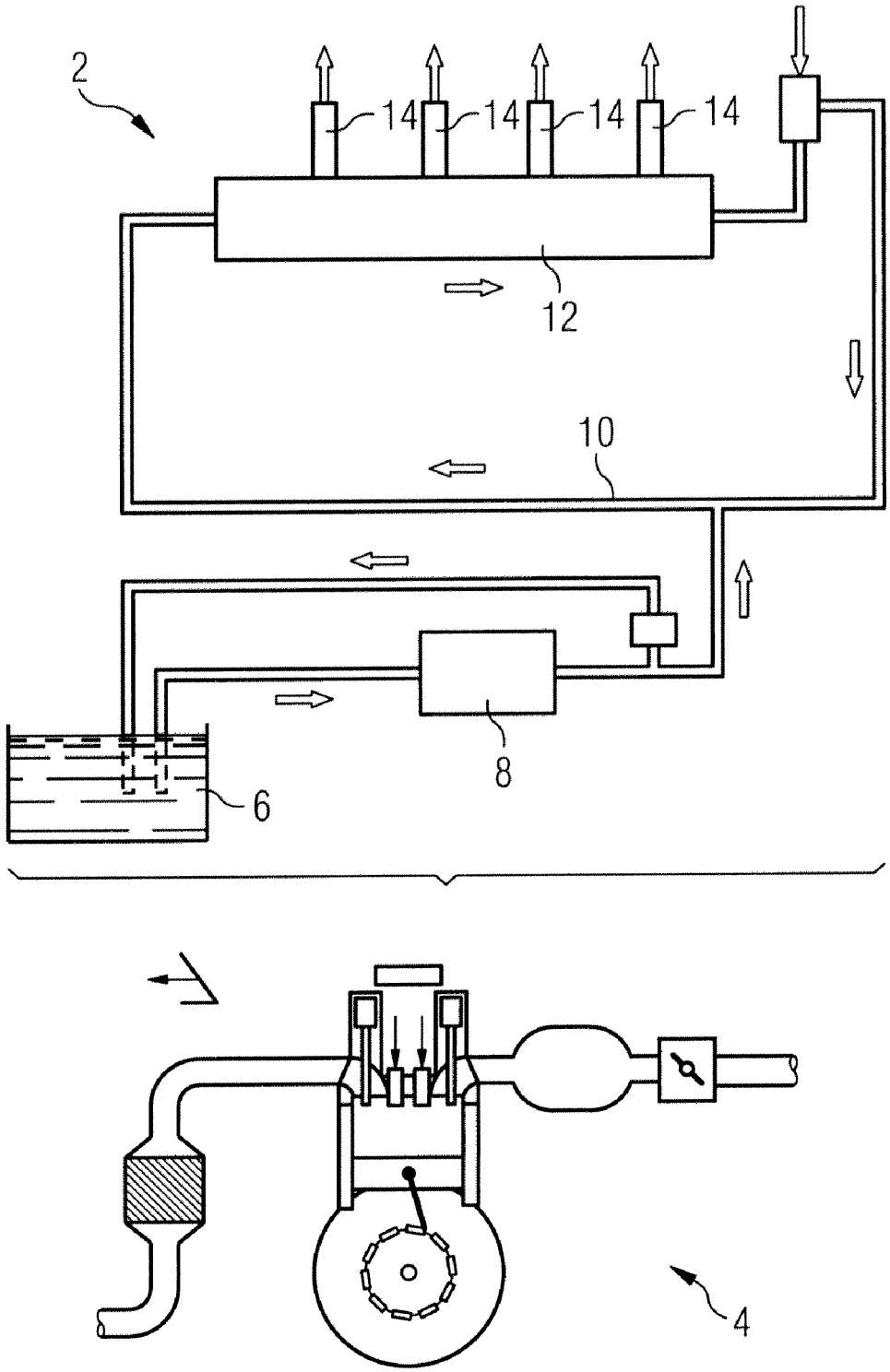
FIG. 1 an internal combustion engine in a schematic view.

FIG. 1 shows the fluid feed device 2 which is assigned to a combustion engine 4. The fluid feed device 2 includes a fluid tank 6 that is connected via a first fluid line to a low-pressure pump 8. The output of the low-pressure pump 6 is connected to a fluid inlet 10 of a fluid rail 12. Fluid injectors 14 are connected to the fluid rail 12. The fluid can be a fuel and is fed to the fluid injectors 14 via the fluid rail 12. The fluid injectors 14 have a sealed connection to the fluid rail 12 and are suitable for injecting fuel into a gasoline engine.

Figure 2:
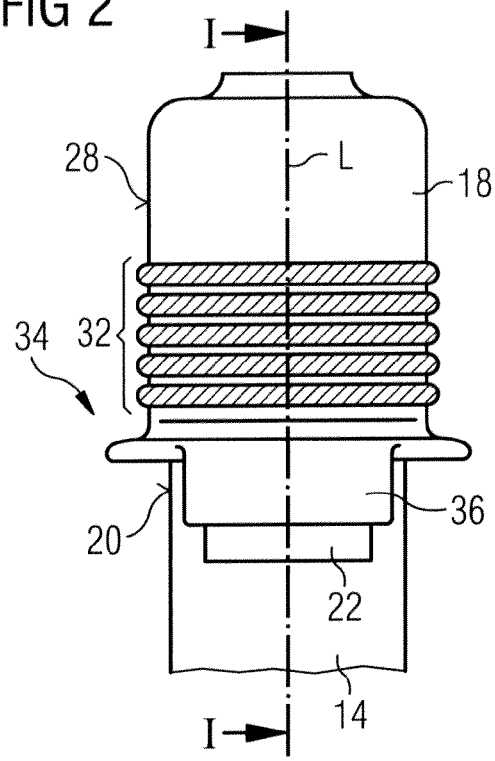
FIG. 2 a first embodiment of the fluid injector assembly in a side view.
Figure 3:
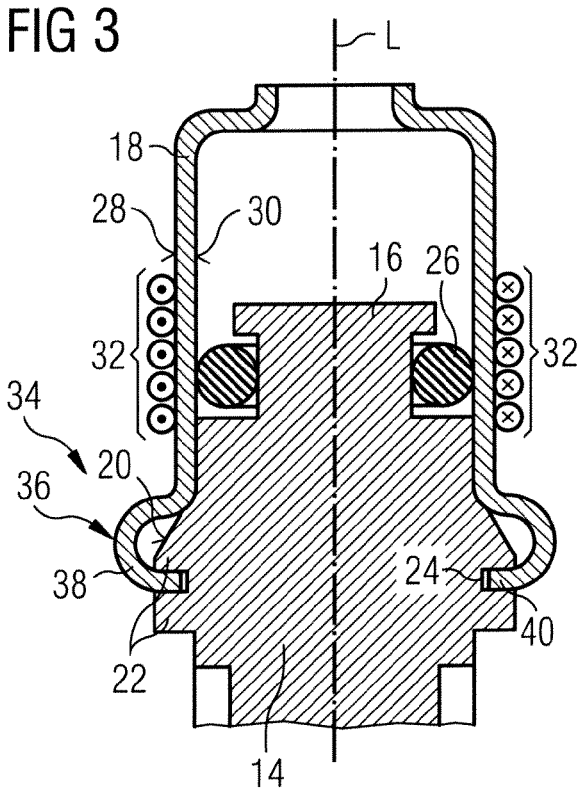
FIG. 3 a longitudinal section through the first embodiment of the fluid injector assembly along line I of FIG. 2, and FIG. 4 an arrangement of four fluid injector assemblies on a fluid rail.

FIGS. 2 and 3 show an embodiment of the fluid injector assembly.

A fluid inlet portion 16 of the fluid injector 14 is coupled to a fluid injector cup 18 of the fluid rail 12. The fluid inlet portion 16 has an outer surface 20 which comprises two opposing projections 22 in radial direction with respect to the central longitudinal axis L. Each of the projections 22 has a groove 24. The fluid inlet portion 16 further comprises a sealing ring 26.

The fluid injector cup 18 has an outer surface 28, an inner surface 30 and comprises a heating device 32 for heating the sealing ring 26 and a coupling section 34. The coupling section 34 comprises two opposing protrusions 36 in radial direction with respect to the central longitudinal axis L. Each of the protrusions 36 has a final section 38 with an edge 40. As can be seen in FIG. 3 the final section 38 of the protrusion 36 is formed in the shape of a semi-circular arc and the edge 40 is orientated in direction to the central longitudinal axis L. The groove 24 of the projection 22 of the fluid inlet portion 16 receives the final section 38 of the protrusion 36 of the fluid injector cup 18.

The fluid injector cup 18 is preferably made out of stainless steel. This allows a good conductivity of the heat being emitted by the heating device 32. Furthermore, this allows an elastic deformation of the protrusions 36 formed in the shape of a semi-circular arc and additionally stainless steel can reduce the corrosion of the fluid injector assembly.

The sealing ring 26 of the fluid inlet portion 16 is arranged between the fluid injector 14 and the fluid injector cup 18 to establish a hydraulic sealing. The surface of the sealing ring 26 is forming a part of the outer surface 20 of the fluid injector 14. The inner surface 30 of the fluid injector cup 18 sealingly engages the outer surface 20 of the fluid injector 14 in the section ring 26.

The heating device 32 at the outer surface 28 of the fluid injector cup 18 is arranged in the section where the inner surface 30 of the fluid injector cup 18 sealingly engages the outer surface 20 of the fluid injector 14. A thermal coupling between the heating device 32 and the sealing ring 26 is established by the fluid injector cup 18.

In a preferred embodiment the heating device 32 is an electrical heater. As can be seen in a section of FIG. 3, the wires of an electrical heater are wrapped around the fluid injector cup 18.

The sealing ring 26 can, for example, be made of rubber. Like other amorphous solids, rubber becomes brittle when it is cooled below a material-specific temperature, the so-called glass transition temperature TG. In a cold environment the temperature of the sealing ring 26 can fall below the glass transition temperature TG of the material of the sealing ring 26. This can especially be the case after the start of the combustion engine 4. The heat which is emitted by the heating device 32 and conducted by the fluid injector cup 18 is transmitted to the sealing ring 26 and ensures the temperature of the sealing ring 26 to remain above a given threshold. This avoids the material of the sealing ring 26, for example rubber, to become brittle when the threshold is at least the glass transition temperature TG of rubber.

Figure 4:
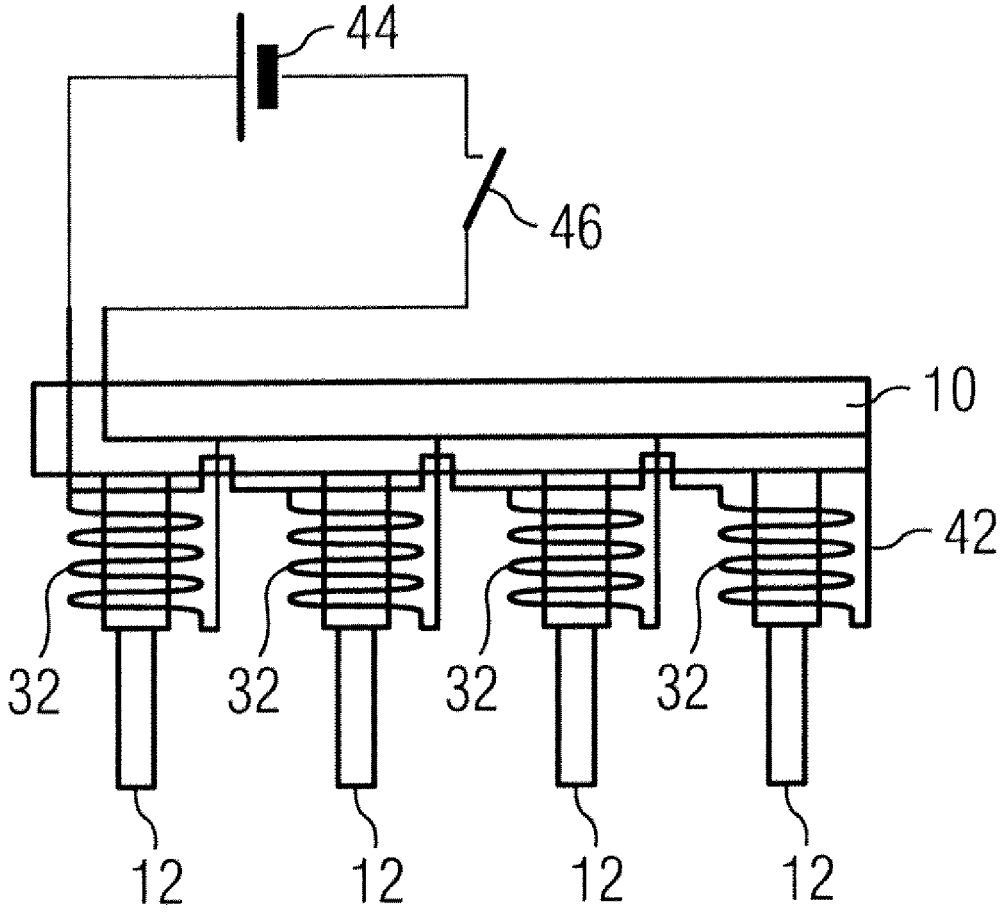

FIG. 4 shows the fluid rail 12 comprising four fluid injector assemblies with the heating device 32 of each fluid injector assembly being an electrical heater. The heating device 32 of each fluid injector assembly is connected via an electrical wire 42 to an electrical power supply 44 and to a switch 46 such that the four fluid injector assemblies are electrically connected in parallel.

What is claimed is:

1. A fluid injector assembly comprising:

a fluid injector with a fluid inlet portion, a fluid injector cup having a wall defining an inner surface and an outer surface, and a heating device arranged on and around the outer surface of the fluid injector cup wall, the fluid inlet portion of the fluid injector comprising a sealing ring being arranged and designed to sealingly engage the inner surface of the fluid injector cup, the fluid injector cup being designed to couple the heating device thermally to the sealing ring of the inlet portion and to couple the fluid inlet portion mechanically, wherein the heating device is axially positioned on a portion of the fluid injector cup wall inside which the sealing ring is located, such that the heating device is conductively coupled to the sealing ring through the fluid injector cup wall.

2. The fluid injector cup according to claim 1, wherein the heating device is an electrical heater.

3. The fluid injector according to claim 1, wherein the fluid inlet portion has an outer surface which comprises two opposing projections in a radial direction with respect to a central longitudinal axis.

4. The fluid injector according to claim 3, wherein each of the projections has a groove.

5. The fluid injector according to claim 1, wherein the fluid injector cup has an outer surface, an inner surface and a coupling section.

6. The fluid injector according to claim 5, wherein the coupling section comprises two opposing protrusions in a radial direction with respect to a central longitudinal axis.

7. The fluid injector according to claim 6, wherein each of the protrusions has a final section with an edge.

8. The fluid injector according to claim 7, wherein the final section of the protrusion is formed in the shape of a semi-circular arc and the edge is orientated in direction to the central longitudinal axis.

9. The fluid injector according to claim 7, wherein the fluid inlet portion has an outer surface which comprises two opposing projections in a radial direction with respect to a central longitudinal axis, wherein each of the projections has a groove and wherein the groove receives the final section.

10. The fluid injector according to claim 1, wherein the fluid injector cup is made out of stainless steel.

11. The fluid injector according to claim 2, wherein the heating device comprises wires which are wrapped around the fluid injector cup.

12. The fluid injector according to claim 1, wherein the sealing ring is made of rubber.

13. A fluid feed device comprising a fluid tank connected via a first fluid line to a low-pressure pump which is connected to a fluid inlet of a fluid rail;

a fluid injector assembly comprising:

a fluid injector with a fluid inlet portion, a fluid injector cup having a wall defining an inner surface and an outer surface, and a heating device arranged on and around the outer surface of the fluid injector cup wall, the fluid inlet portion of the fluid injector comprising a sealing ring being arranged and designed to sealingly engage the inner surface of the fluid injector cup, the fluid injector cup being designed to couple the heating device thermally to the sealing ring of the inlet portion and to couple the fluid inlet portion mechanically, wherein the heating device is axially positioned on a portion of the fluid injector cup wall inside which the sealing ring is located, such that the heating device is conductively coupled to the sealing ring through the fluid injector cup wall.

14. The fluid feed device according to claim 13, wherein the fluid injector has a sealed connection to the fluid rail.

15. The fluid feed device according to claim 13, comprising a plurality of fluid injector assemblies, wherein the heating device of each fluid injector assembly is connected via an electrical wire to an electrical power supply and to a switch such that the fluid injector assemblies are electrically connected in parallel.

16. The fluid feed device according to claim 13, wherein the heating device comprises wires which are wrapped around the fluid injector cup.

17. The fluid feed device according to claim 13, wherein the sealing ring is made of rubber.

18. The fluid feed device according to claim 13, wherein the fluid inlet portion has an outer surface which comprises two opposing projections in a radial direction with respect to a central longitudinal axis.

19. The fluid feed device according to claim 18, wherein each of the projections has a groove.

* * * * *